US006749447B2

(12) United States Patent
Mastoris et al.

(10) Patent No.: US 6,749,447 B2
(45) Date of Patent: Jun. 15, 2004

(54) METHODS AND DEVICES FOR PROTECTING PINS OF A PIN CONNECTOR

(75) Inventors: Steven F. Mastoris, El Dorado Hills, CA (US); Akbar Monfared, Placerville, CA (US); Ian Robert Inglis, Rocklin, CA (US)

(73) Assignee: Hewlett-Packard Developement Company, L.P., Houston, TX (US)

( * ) Notice: Subject to any disclaimer, the term of this patent is extended or adjusted under 35 U.S.C. 154(b) by 0 days.

(21) Appl. No.: 10/192,462

(22) Filed: Jul. 9, 2002

(65) Prior Publication Data

US 2004/0009688 A1 Jan. 15, 2004

(51) Int. Cl.[7] ..... H01R 13/44
(52) U.S. Cl. ..... 439/148; 439/149
(58) Field of Search ..... 439/135, 148, 439/149, 367; 206/709, 714, 719, 722, 723; 211/26

(56) References Cited

U.S. PATENT DOCUMENTS

| | | | | | |
|---|---|---|---|---|---|
| 4,197,945 | A | * | 4/1980 | Sherwood | 439/149 |
| 5,106,313 | A | * | 4/1992 | Lwee et al. | 439/135 |
| 5,215,474 | A | * | 6/1993 | Rotella | 439/149 |
| 5,601,444 | A | * | 2/1997 | Cox | 439/148 |
| 5,756,937 | A | * | 5/1998 | Gleadall | 439/135 |
| 6,166,919 | A | * | 12/2000 | Nicolici et al. | 439/148 |
| 6,480,379 | B1 | * | 11/2002 | Dickey et al. | 361/687 |

* cited by examiner

*Primary Examiner*—Renee S. Luebke
*Assistant Examiner*—Felix O. Figueroa

(57) ABSTRACT

A protective cover for a pin connector of a backplane includes at least one connector having receptacles for receiving the pins of a pin connector of a backplane and a planar member extending from the connector, the connector being on the planar member.

2 Claims, 4 Drawing Sheets

METHODS AND DEVICES FOR PROTECTING PINS OF A PIN CONNECTOR

FIELD OF THE INVENTION

The present invention relates to the field of connectors. More specifically, the present invention relates protecting the pins of a pin connector, particularly a pin connector on a backplane of, for example, a blade server.

BACKGROUND OF THE INVENTION

Computers and their peripheral devices are used for a wide variety of purposes including, data storage, communication, and document creation. Peripheral Component Interconnect (PCI) is a local bus that is commonly used to connect a computer with one or more peripheral devices. A PCI bus provides a high-speed connection with peripherals and can connect multiple peripheral devices to the host computer. The PCI bus typically plugs into a PCI slot on the motherboard of the host computer.

CompactPCI or "cPCI" was introduced in 1995 based on the PCI standard and has since become one of the fastest-growing industrial bus architectures to date. Initially targeted at the telecommunications and industrial control markets, CompactPCI takes the popular PCI interface and packages it into a smaller, more rugged unit. The most noticeable change made to the architecture was the adoption of a form factor in which all dimensions and mechanical components are standardized by the Institute of Electrical and Electronics Engineers (IEEE). Consequently, numerous vendors can supply mechanically interchangeable components.

One particularly important use of the CompactPCI is in a blade server, also called an ultradense server. Blade servers are comprehensive computing systems that include processor, memory, network connections, and associated electronics, all mounted on a single motherboard called a blade. There are many types of blades—server blades, storage blades, network blades and more.

The server blade, along with storage, networking and other blades, are typically installed in a rack-mountable enclosure that houses multiple blades that share common resources such as cabling, power supplies, and cooling fans. The blades are connected into a common circuit board, called a backplane, that provides connections to and between blades for both data and power. With its modular, hot-pluggable architecture, the easily accessible blade server offers increased computing density while ensuring both maximum scalability and ease of management.

Typically, the backplane provides rows of pins, preferably configured according to the cPCI standard, for connection to the various blades that might be installed in the blade server. The blades each have a corresponding connector that includes receptacles or holes in which the pins of the connector on the backplane are received when the blade is installed. Because of the complex and tightly packed circuitry that may exist on a blade, a large number of connections are required between the blade and the backplane. Consequently, there are a relatively large number of delicate pins provided in each connection row on the backplane that might receive a blade.

The pins are packed close together, preferably according to the cPCI standard, to provide the necessary number of connections within an appropriate amount of real estate on the backplane. In part, because the pins are so closely packed together, the pins are relatively thin and, therefore, somewhat delicate. A pin can easily be bent or broken.

Damage to the pins can occur when a blade is improperly installed. Damage to the pins can also occur during the storage or shipping of the backplane.

If a pin is broken or bent and fails to make a connection with an installed blade, the blade will likely not function properly, and it may be very difficult to identify the problem as bent or missing pin among so many pins on the backplane. Consequently, it becomes important to take any precautions possible to protect the pins of the backplane and prevent any damage being done to any pin, whether during manufacturing, shipping or while the backplane is in service.

SUMMARY OF THE INVENTION

In one of many possible embodiments, the present invention provides a protective cover for a pin connector of a backplane, the cover including at least one connector having receptacles for receiving pins of a pin connector of a backplane, a planar member extending from the at least one connector, the at least one connector being on the planar member; and a plate attached to the planar member at an edge opposite the at least one connector.

In another embodiment, the present invention provides a protective cover for a pin connector of a backplane, the cover including at least one connector having receptacles for receiving pins of a pin connector of a backplane, a handle extending from the at least one connector for installing or removing the protective cover, and clips extending from the cover for clipping the cover to the pin connector of a backplane.

In another embodiment, the present invention provides, a method of protecting pins of a pin connector of a backplane by installing a protective cover over the pins of the pin connector, the protective cover comprising at least one connector having receptacles for receiving the pins of the pin connector of the backplane and a handle extending from the at least one connector; and clipping the protective cover to the pin connector with clips disposed on the protective cover.

In another embodiment, the present invention provides a method of making a protective cover for pins of a pin connector of a backplane by obtaining a number of connectors having receptacles for receiving the pins, sizing the connectors to a common thickness, and attaching the connectors to a planar member.

In another embodiment, the present invention provides, a method of protecting pins of a pin connector of a backplane by installing a protective cover over the pins of the pin connector, the protective cover comprising at least one connector having receptacles for receiving the pins of the pin connector of the backplane; dividing a rack of a blade server containing the backplane with a planar member extending from the at least one connector; and securing the divider and protective cover in the rack with attachment means, disposed on the planar member, for attaching to the rack.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate similar, but not necessarily identical, elements.

DETAILED DESCRIPTION OF THE PREFERRED EMBODIMENTS

Figure 1:
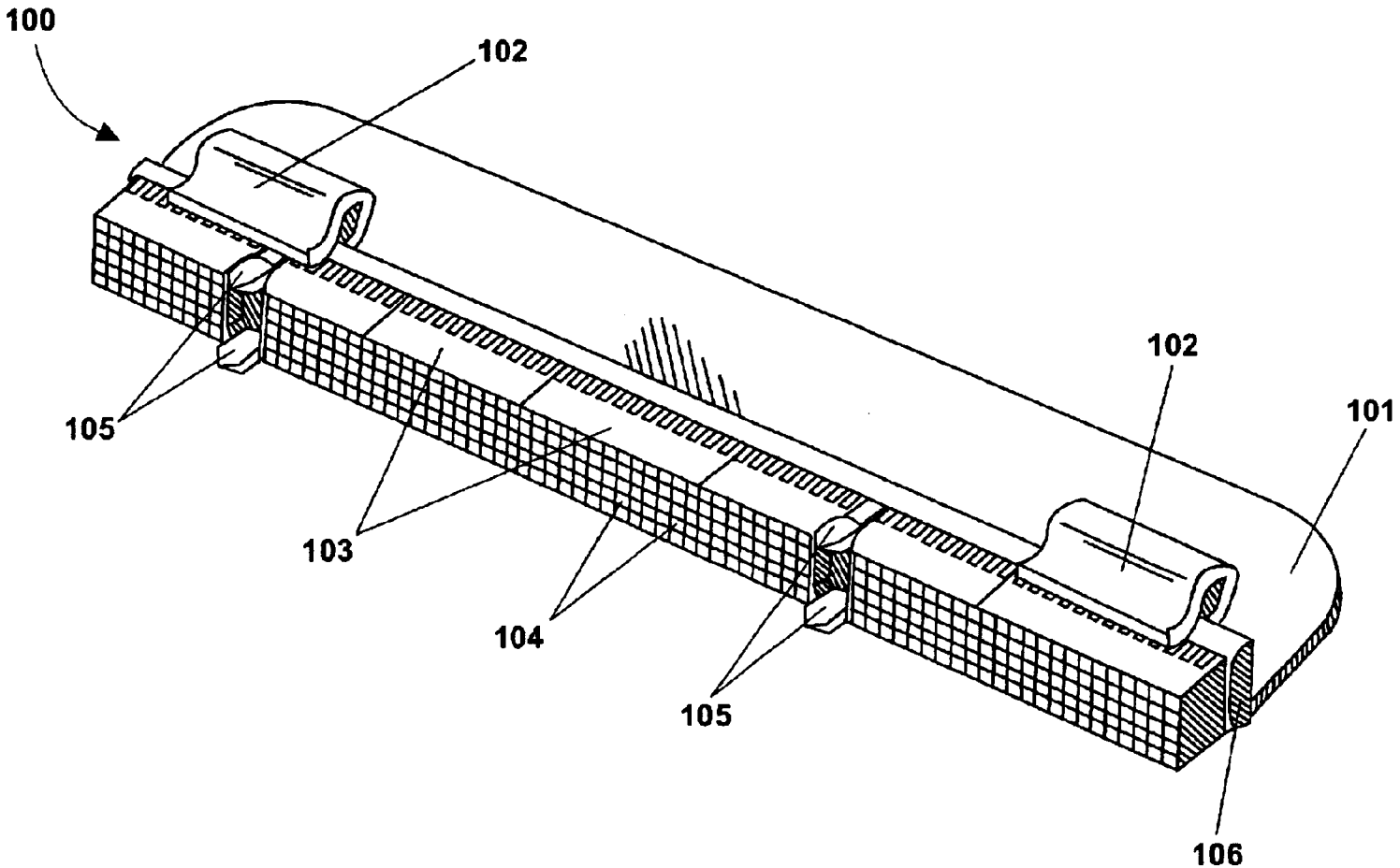
FIG. 1 is an illustration of a protective cover for the pins of a backplane according to an embodiment of the present invention.

FIG. 1 is an illustration of a protective cover (100) for the pins of a backplane according to an embodiment of the present invention. As shown in FIG. 1, the protective cover (100) preferably includes connector blocks (103) that are arranged in a row corresponding to a row of pins on a backplane for receiving a blade. Alternatively, the connector (103) of the protective cover (100) may be a single unit from a solid material of similar form factor. These connectors (103) include holes or receptacles (104) in which the pins of the backplane are received. Preferably, these receptacles (104) are arranged according to the cPCI standard.

The connectors (103) are secured to a plate (106) so that they can be installed or removed as a unit. A handle (101) may be connected to, or integrally formed with, the plate (106) to facilitate handling of the protective cover (100).

A pair of clips (102) are also attached to, or integrally formed with, the plate (106). One clip (102) is preferably disposed at each end of the plate (106). These clips (102) can be used to help retain the protective cover (100) in place on a pin connector of a backplane being protected. The user of the cover (100), and the clips (102) in particular, will be explained further below. Preferably, the handle (101) and the clips (102) are arranged along opposite edges of the plate (106).

Guides (105) may be disposed in between the connectors (103) at various points on the protective cover (100). On the connector of a blade, these or similar guides would be used to hold a key that is specific to the type of blade on which the keys are installed. These blade keys are matched by corresponding keys in between the connection pins on a connector of the backplane.

This key arrangement insures that only a particular type of blade can be connected to a particular connector on the backplane for receiving that type of blade. Thus, if a connector on a backplane is arranged to receive only a single type of blade, the keys in that backplane connector will prevent any other type of blade from being installed in that connector.

Keys may or may not be loaded into the guides (105) of the protective cover (100). The use of keys in the cover (100) is not necessary for the cover (100) to protect the pins of a backplane connector.

The protective cover (100) can be constructed by taking standard connectors (103), preferably compliant with the cPCI standard, and sizing those connectors (103) down for attachment to the plate (106). Alternatively, the protective cover (100) can be constructed from any integration of the various components described above.

Figure 2:
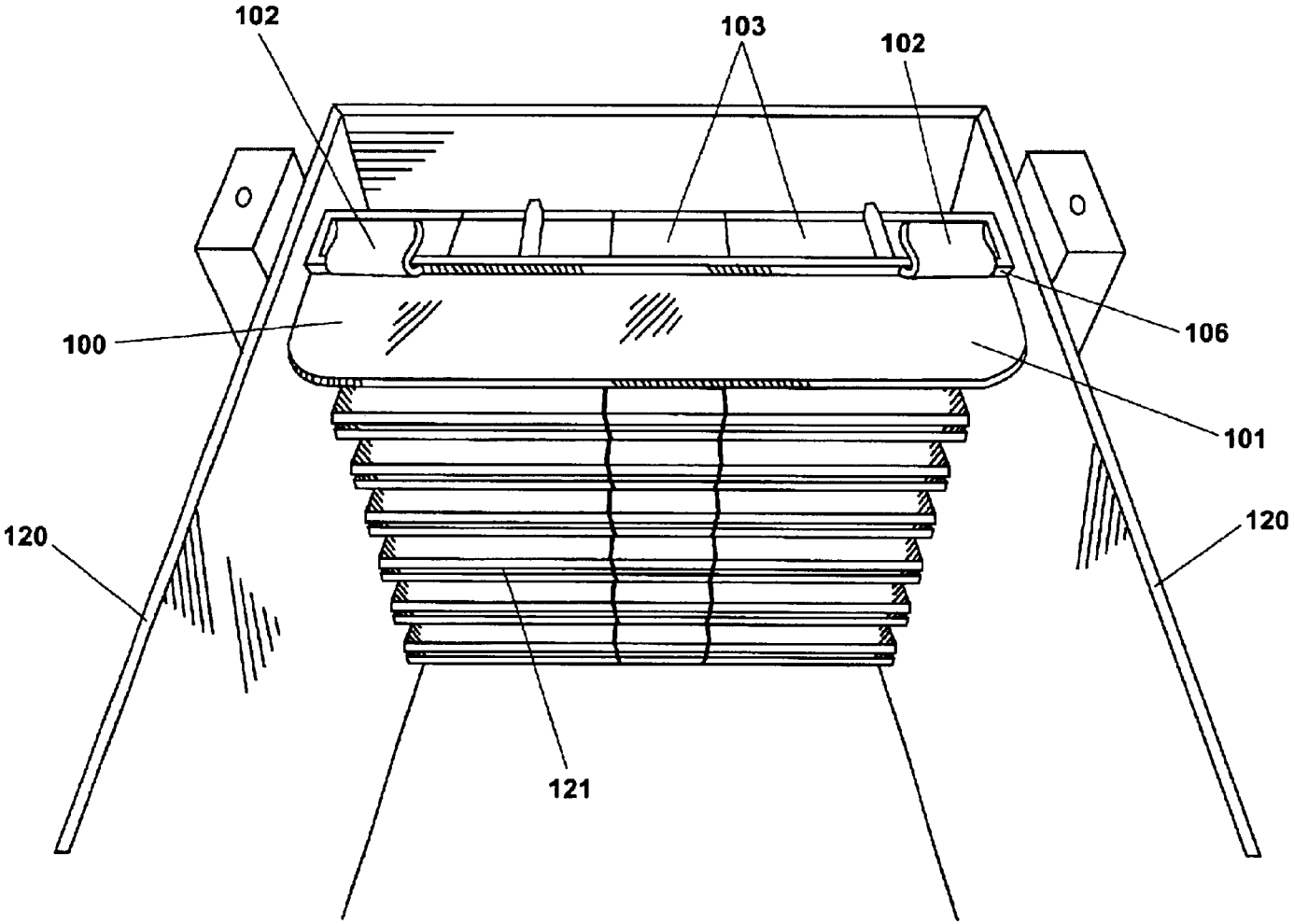
FIG. 2 is an illustration of the protective cover of FIG. 1 installed on a backplane.

FIG. 2 is an illustration of the protective cover of FIG. 1 installed on a backplane. As shown in FIG. 2, a backplane (121) is installed in the rack (120) of a blade server. Various blades can then be installed within the rack (120) by connection with the backplane (121) to complete the blade server.

At any point in time, there may well be connectors on the backplane, comprised of connections pins, that are not in use, i.e., have no blade attached thereto. This may be true when the backplane (121) is in manufacture, storage or shipping, or after being placed in service. In any case, a protective cover (100) can be installed on any such unoccupied connector of the backplane (121). The pins of that connector on the backplane (121) are received in the receptacles (104; FIG. 1) of the protective cover (100) and are, thereby, protected from being bent, broken or otherwise damaged. FIG. 2 illustrates the protective cover (100) installed on a pin connector of a backplane (121).

If the protective cover (100) is used to protect pin connectors on the backplane (121) when the backplane (121) is in service in a blade server, there will likely be some pin connectors on the backplane (121) hosting blades and other pin connectors that are unoccupied on the backplane. These unoccupied pin connectors may be covered and protected by a protective cover (100).

As shown in FIG. 2, the clips (102) can engage the sides of the pin connector on the backplane (121) to better hold the protective cover (100) in place over the connector being protected. This may be particularly useful when, as pictured in FIG. 2, the backplane (121) is oriented vertically.

It may be desirable, in some circumstances, to separate or divide the blades installed in the blade server. It may be desirable to separate the blades merely according to the types of blades installed in the blade server. It may be desirable to separate blades that are working together in a particular or logical arrangement. It may also be desirable to separate the blades to contain and prevent the spread of an electrical fire or other problems that may arise in one of the blades.

Figure 3:
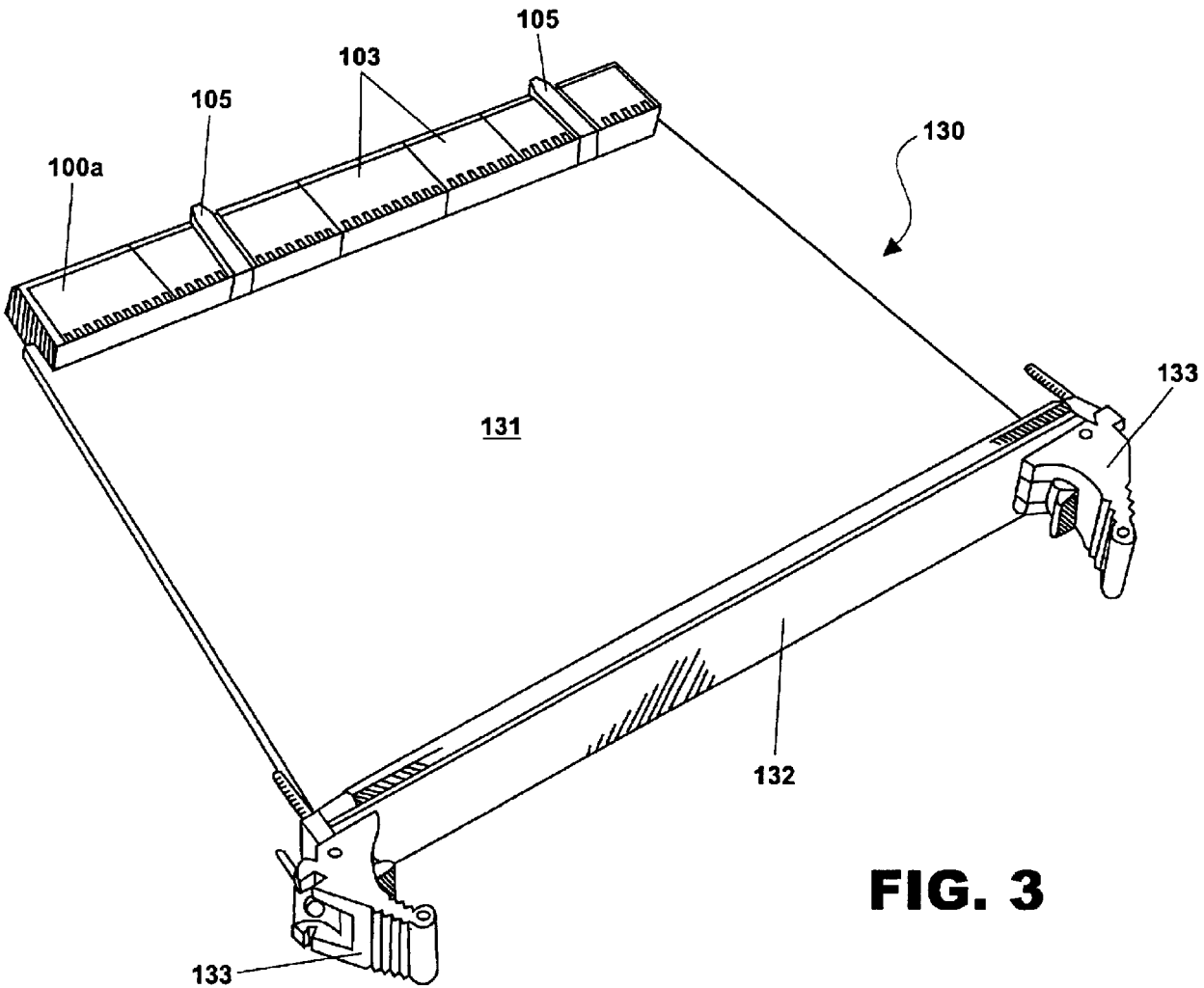
FIG. 3 is an illustration of a protective cover integrated with a divider according to an embodiment of the present invention.

FIG. 3 is an illustration of a divider according to an embodiment of the present invention that is integrated with a protective cover like, for example, that of FIG. 1. This divider (130) can be installed in any open slot for a blade in a blade server to divide the blades on either side of that slot.

The divider (130) preferably includes a planar member (131) that can be formed, for example, of a blank circuit board, a printed circuit board, a substrate, sheet metal, etc. The planar member (131) serves to divide portions of a blade sever rack or separate blades or groups of blades in a blade server.

A plate (132) is preferably provided on an edge of the divider (130) to facilitate handling, installation and removal of the divider (130). The plate (132) preferably includes handles (133) at either end for facilitating installation or removal of the divider (130). These handles (133) also preferably include means for securing the divider (130) in the rack of a blade server, for example, screws, clamps, etc. In this respect, the planar member (131) is preferably sized similarly to the circuit board of a blade, and the plate (132) and clamps (133) are similar in size and shape to a corresponding plate and clamps of a blade for a blade server.

At the opposite end of the planar member (131), a protective connector cover **(100*a*) is attached to, or integrated with, the planar member (131) of the divider (130)**.

The protective cover (100*a*) is similar in many respects to the protective cover (100) described above in connection with FIG. 2.

As shown in FIG. 3, the protective cover (100*a*) preferably includes connector blocks (103) that are arranged in a row corresponding to a row of pins on a backplane for receiving a blade. Alternatively, the connector (103) of the protective cover (100*a*) may be a single unit made from a solid material of similar form factor. The connector or connectors (103) are attached to, or formed integrally with, the planar member (131). The connector or connectors (130) include holes or receptacles (104) in which the pins of the backplane are received. Preferably, these receptacles (104) are arranged according to the cPCI standard. In a number of connectors (103) are used, they are secured to the planar member (131) for easy installation or removal as a unit. A handle (101) may be connected to, or integrally formed with, the plate (106) to facilitate handling of the protective cover (100).

As before, guides (105) may be disposed in between the connectors (103) at various points on the protective cover (100*a*). On the connector of a blade, these or similar guides would be used to hold a key that is specific to the type of blade on which the keys are installed. Keys may or may not be loaded into the guides (105) of the protective cover (100*a*). The use of keys in the cover (100*a*) is not necessary for the cover (100*a*) to protect the pins of a backplane connector.

The protective cover (100) can be constructed by taking standard connectors (103), preferably compliant with the cPCI standard, and sizing those connectors (103) down for attachment to the planar member (131). Alternatively, the protective cover (100*a*) can be constructed from any integration of the various components described above.

Figure 4:
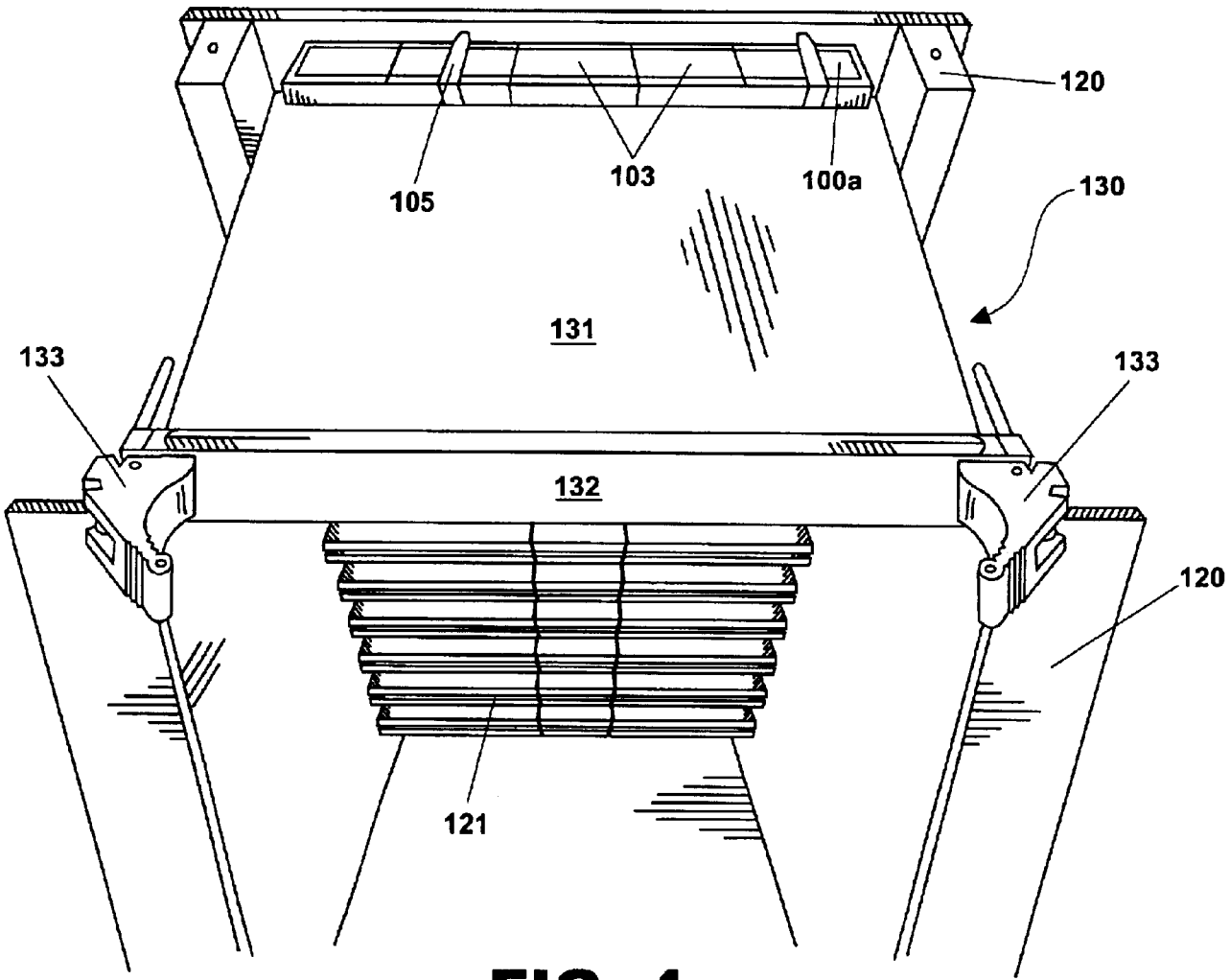
FIG. 4 is an illustration of the protective cover of FIG. 3 installed on a backplane.

FIG. 4 is an illustration of the protective cover of FIG. 3 installed on a backplane (121). As shown in FIG. 4, the divider (130), including the protective cover (100*a*), can be installed in the rack (120) of a blade server. The protective cover (100*a*) then receives and protects the pins of a blade connector on the backplane of the blade server, while the divider (130) divides the blades or blade slots on either side of the blade slot in which the divider (130) is installed.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A protective cover for a pin connector of a backplane, said cover comprising:

at least one connector having receptacles for receiving pins connector of a backplane, wherein said receptacles are not electrically connected to a circuit board or circuit elements;

a planar member extending from said at least one connector, said at least one connector being on said planar member; and a plate attached to said planar member at an edge opposite said at least one connector wherein said plate further comprises two handles that include means for securing said plate to a rack of a blade sever containing said backplane.

2. The protective cover of claim 1, wherein said handles and plate are sized and shaped like corresponding members on a blade of said blade server.

* * * * *